10/30/84 XR 4,480,254

United States Patent [19]

Spencer et al.

[11] Patent Number: 4,480,254

[45] Date of Patent: Oct. 30, 1984

[54] ELECTRONIC BEAM STEERING METHODS AND APPARATUS

[75] Inventors: Donald B. Spencer, Federal Way; John L. Fitch, Seattle, both of Wash.

[73] Assignee: The Boeing Company, Seattle, Wash.

[21] Appl. No.: 431,058

[22] Filed: Sep. 30, 1982

[51] Int. Cl.[3] ..... H01Q 19/06; H01Q 15/08

[52] U.S. Cl. ..... 343/708; 343/754; 343/787; 343/911 R

[58] Field of Search ..... 343/705, 708, 753, 754, 343/755, 787, 909, 911 R

[56] References Cited

U.S. PATENT DOCUMENTS

| | | | |
|---|---|---|---|
| 2,959,783 | 11/1960 | Iams | 343/754 |
| 3,255,451 | 6/1966 | Wolcott | 343/754 |
| 4,323,901 | 4/1982 | De Wames | 343/754 |

*Primary Examiner*—Eli Lieberman

*Attorney, Agent, or Firm*—Hughes, Barnard & Cassidy

[57] ABSTRACT

Methods and apparatus for electronically steering a radio frequency signal beam (RF) along at least one of "X" and/or "Y" coordinates with respect to the axis of the signal beam (RF) and comprising n pairs of back-to-back prisms (20, 21) formed of ferroelectric dielectric material such, for example, as $BaTiO_3$, $LiNbO_3$, $LiTaO_3$, $Bi_{12}SiO_{20}$ (BSO) and $Bi_{12}GeO_{20}$ (BGO), means for applying voltages across terminals (A, B and C, D) of the prisms (20, 21) so as to establish separate and independent DC electric fields in the prisms (20, 21) and for varying the voltage applied across the terminals of one prism (20) relative to the voltage applied across the terminals of the other prism (21) in each of the n pairs of prisms so as to alter the incremental permittivity of one prism (20) in each of the n pairs relative to the other prism in each of the n pairs (n), thereby changing the prism refraction angles and controllably deflecting the direction of the radiated energy beam to one side or the other of the undeflected beam axis. The beam steering system is highly versatile and may be used with any type of fixed beam antenna; it may comprise a composite structure (30) including two pairs of back-to-back prisms (20, 21 and 20', 21') for steering the beam along either or both of "X" and/or "Y" coordinates; and, it may be used to steer electromagnetic beams in the millimeter wave, centimeter wave, infrared wave and optical wave regions.

16 Claims, 10 Drawing Figures

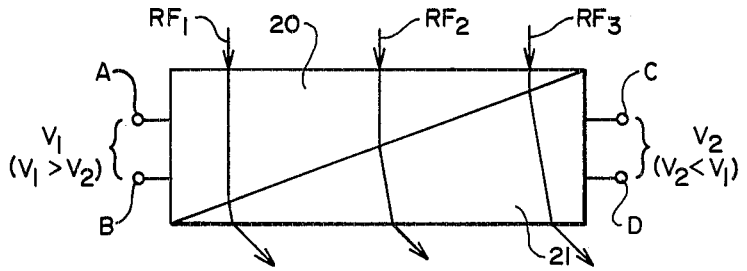
FIG. 5
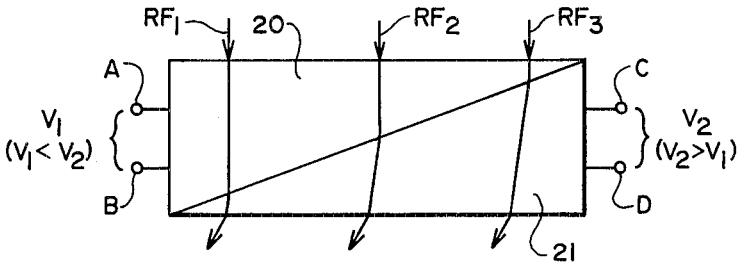
FIG. 6
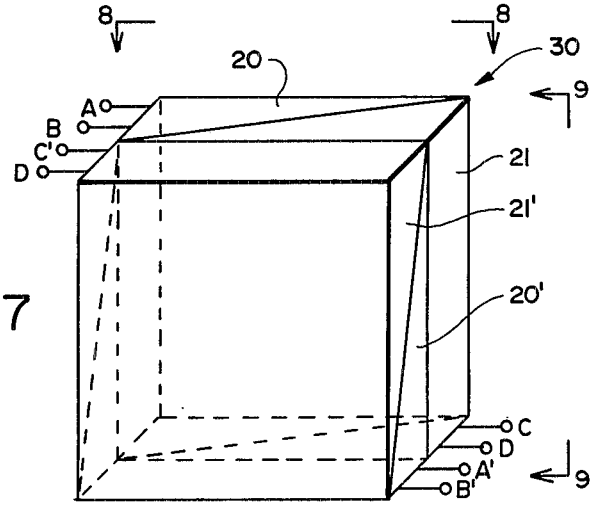
FIG. 7
FIG. 8
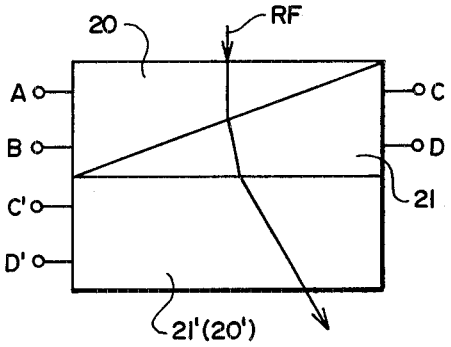
FIG. 9
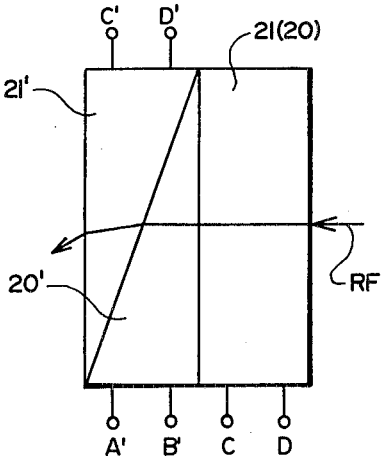
FIG. 10
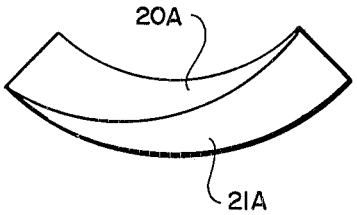

ELECTRONIC BEAM STEERING METHODS AND APPARATUS

BACKGROUND OF THE INVENTION

1. Technical Field

The present invention relates generally to a passive or static electronic beam steering system; and, more particularly, to an improved beam steering system totally devoid of moving parts, yet which is characterized by its ability to steer an energy beam or radio frequency ("RF") signal precisely and rapidly along "X" coordinates, "Y" coordinates, or "X" and "Y" coordinates. In the exemplary form of the invention, the passive electronic beam steering system finds particularly advantageous use in steering millimeter wavelength beams of the type commonly employed in aircraft and/or missile target acquisition systems; but, as the ensuing description proceeds, those skilled in the art will appreciate that the invention also finds advantageous application when dealing with centimeter wave systems, as well as with infrared and optical systems. The electronic beam steering system of the present invention is characterized by its reliability, precision, lightweight construction, relatively small dimensions, high scanning rates, and minimum maintenance and service requirements, all achieved at relatively low cost when contrasted with conventional dynamic mechanical beam steering apparatus.

2. Background Art

The present invention is here described in conjunction with an exemplary airborne millimeter wavelength radar target acquisition system of the type commonly employed with aircraft and/or missiles; although, it will be understood that in its broader aspects, the invention can be employed in a wide variety of environmental applications including millimeter, centimeter, infrared or optical wavelength regions, and with virtually any conventional type of antenna. Conventionally, such target acquisition beam steering systems have employed mechanical beam steering arrangements (which may be either electrically or hydraulically actuated), and electronic systems utilizing phase shifting elements. Mechanical systems, however, have numerous inherent disadvantages. For example, such systems are commonly relatively large, heavy, and characterized by unacceptably slow scanning rate limitations. Because such mechanical beam steering systems incorporate relatively moving parts, sophisticated lubricating systems are commonly needed and the precision and reliability of such mechanical systems are commonly degraded by wear of the moving parts. Moreover, physical movement of the center of mass of such mechanical components introduces unwanted errors into the vehicle guidance system. And, of course, since the antenna must be movable within the host vehicle, it must be undersized with respect to the compartment within which it is mounted so as to permit such movement; and this constitutes an undesirable limiting constraint, especially where the host vehicle comprises a small diameter missile.

Efforts have been made to overcome the foregoing problems by design of electronic scanning systems employing phase shifting arrangements; but, such apparatus has not proven satisfactory when dealing with wavelengths on the order of a few millimeters. Moreover, the diode switches commonly employed as electronic phase shifting elements tend to become excessively lossy.

The present invention takes advantage of the phenomenon of electronic beam steering utilizing ferroelectric dielectric materials wherein the dielectric constant (index of refraction) of prisms formed of such materials can be controllably changed to selectively and controllably vary the prism refraction angle and thus deflect the direction of the energy beam. The characteristics of such materials are well known and have been described in, for example, a paper presented by M. B. Klein, A. E. Popa, and D. M. Henderson at the Fourth International Conference On Infrared And Millimeter Waves And Their Applications, and entitled "Phase Shifting At 94 GHz Using Bulk Crystals", IEEE PROCEEDINGS, pp. 280-281 (Dec. 10-15, 1979, Miami Beach, Fla.) wherein the authors report on the characteristics of such ferroelectric dielectric materials as $BaTiO_3$, $LiNbO_3$, $LiTaO_3$, $Bi_{12}SiO_{20}$ (BSO) and $Bi_{12}GeO_{20}$ (BGO).

One proposed prior approach to an electronic scanning antenna employing a ferroelectric dielectric material—barium titanate ($BaTiO_3$)—is that described in U.S. Pat No. 2,959,783—Iams. The system disclosed in this patent employs a prism formed of barium titanate and means for varying the voltage field applied to the dielectric material so as to vary the dielectric constant and thus deflect the energy beam. The arrangement disclosed is, however, characterized by a number of disadvantages. For example, the use of a single prism results in a nonsymmetrical beam steering arrangement wherein the beam is always bent to some degree, thus necessitating skewing or nonsymmetrical mounting of the system within a radome or the like; the system is capable of varying the degree of beam deflection in only a single plane; and, because the prism is not of constant thickness, beam energy is unequally attenuated across the prism, resulting in undesired defocusing of the beam.

Another proposed approach to electronic beam steering is that found in U.S. Pat. No. 4,323,901—Wames et al. As here proposed, it is contemplated that the dielectric material include a plurality of electrodes and means for setting up a plurality of controllable electric fields in the dielectric material so as to vary the dielectric constant and permit controlled steering of an electromagnetic wave. However, the construction suggested is such that the electric fields established will vary widely across the dielectric material with the energy field being relatively high near each electrode and relatively low at the midpoints between adjacent electrodes. As a consequence, the dielectric constant and index of refraction are characterized by ripples, waves and highly undesirable distortion of the beam.

SUMMARY OF THE INVENTION

A passive electronic beam steering system is disclosed characterized by employment of one or more pairs of back-to-back prisms formed of ferroelectric dielectric material and configured such that the beam steering structure is of constant thickness so as to insure that the beam energy is attenuated equally across the beam deflecting structure and which permits of virtually instantaneous reliable steering of the beam in a selected plane or planes; yet, wherein the beam is not decollimated or defocused. In carrying out the invention, the beam steering structure can be configured such that the beam can be precisely steered along an "X" coordinate, a "Y" coordinate, or both "X" and "Y"

coordinates; the structure can be conformal in shape to the radome construction employed with the vehicle within which it is mounted, be it an aircraft, missile or other vehicle; and, it can be used with virtually any conventional type of radar antenna. Because the beam is electronically steered and the beam steering structure is devoid of moving parts, steering of the beam can be substantially instantaneous—i.e., in the matter of only a millisecond—yet no change of the center of mass occurs which would otherwise introduce undesirable error inputs to the vehicle guidance system. The system readily permits attainment of the requisite strong electric fields with relatively low voltages; and, additionally, the electric fields produced tend to be extremely uniform across the ferroelectric dielectric material, thereby minimizing beam distortion and/or defocusing.

More specifically, it is a general aim of the present invention to provide a simple, compact, lightweight, inexpensive passive electronic beam steering system of the foregoing character which overcomes the disadvantages inherent with known mechanical beam steering systems and electronic phase shifting systems; and, moreover, which is characterized by its reliability in operation.

A further object of the invention is the provision of a passive electronic beam steering system which is characterized by extremely high scan rates and wherein the beam can be substantially instantaneously redirected within a wide range of deflection angles—i.e., the beam can be shifted from one limit position to the opposite limit position along a given coordinate in on the order of only a millisecond—yet, wherein there is no movement of any physical component and, consequently, no change in the center of mass for the system which would otherwise tend to introduce undesired error signals into the vehicle guidance system.

In another of its important aspects, it is an object of the invention to provide highly versatile electronic beam steering methods and apparatus which permit of use in a wide variety of different applications including, but not limited to, airborne radar systems, missile target acquisition systems, and the like; and, which finds equally advantageous use with virtually any known type of antenna installation and with a wide variety of different wavelength RF signals including millimeter wavelengths, centimeter wavelengths, infrared wavelengths and optical wavelengths.

DESCRIPTION OF THE DRAWINGS

These and other objects and advantages of the present invention will become more readily apparent upon reading the following detailed description and upon reference to the attached drawings, in which:

FIG. 5 is a diagrammatic view similar to that shown in FIG. 4, but here illustrating the crystals and their beam steering characteristics when the voltages applied across the crystal terminals are selected so as to cause the energy beam to be directed or steered to the right as viewed in the drawing along a preselected path;

FIG. 6 is a diagrammatic view similar to FIGS. 4 and 5, but here illustrating the crystals having voltages applied thereto suitable for causing the transmitted beam to be directed or steered to the left as viewed in the drawing;

FIG. 7 is a diagrammatic perspective view of two pairs of beam steering crystals disposed in back-to-back relationship with one pair of crystals (the back pair as viewed in the drawing) being configured to permit electronic steering of the beam along an "X" axis and the other pair of crystals (here the front crystals as viewed in the drawing) being configured to permit electronic steering of the beam along the "Y" axis at right angles to the "X" oriented beam steering characteristics of the rearmost pair of crystals;

FIG. 8 is a diagrammatic view taken substantially along the line 8—8 in FIG. 7 and illustrating particularly a typical "X" axis deflection of the beam when suitable differential voltages are applied across the terminals of the rearmost pair of crystals shown in FIG. 7;

FIG. 9 is a diagrammatic view taken substantially along the line 9—9 in FIG. 7 and illustrating "Y" axis beam steering produced by the front pair of crystals in FIG. 7 when suitable unequal voltages are applied across the terminals of the two forward crystals; and, FIG. 10 is a diagrammatic view similar to FIG. 2, but here illustrating a modified dual crystal electronic beam steering device in which the crystals are in the shape of back-to-back complimentary curved configurations.

Figure 1:
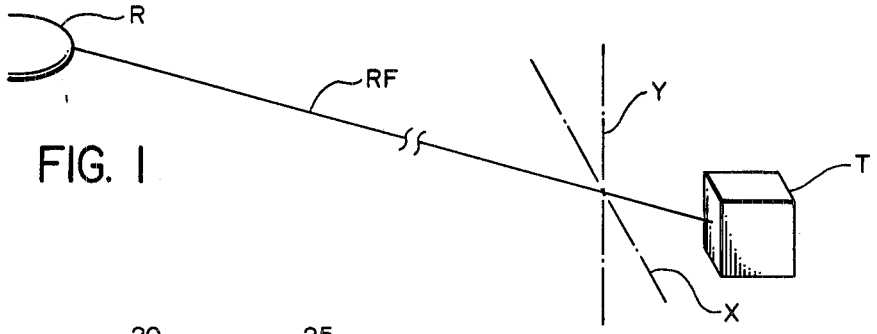
FIG. 1 is a diagrammatic perspective view illustrating a steerable radar beam extending from an airborne radome (which may be associated, for example, with an aircraft or a missile, not shown) and a ground target with the beam being steerable in either or both of horizontal and vertical "X" and "Y" planes so as to permit acquisition of target data.

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and alternatives falling within the spirit and scope of the invention as expressed in the appended claims.

DETAILED DESCRIPTION

Environment Of The Invention

Referring first to FIG. 1, there has been diagrammatically illustrated a typical environment within which the present invention finds especially advantageous use. Thus, as here shown, a radio frequency signal beam RF is being directed from the radome R associated with, for example, an aircraft or missile (not shown) towards a target T located at some distance from the vehicle. In this type of an environment, those skilled in the art will appreciate that the vehicle—be it an aircraft or a missile—will be moving at a relatively high rate of speed, while the target T may be stationary or may be moving in virtually any direction and at virtually any speed. In such an arrangement, it is generally desirable that the beam RF emanating from the radome R be steerable along "X" coordinates and/or "Y" coordinates so as to permit collection of reflected signal data from diverse targets and evaluation of the data collected. It is within this general environmental background that conventional beam steering systems employing a mechanically moveable radar antenna have been utilized.

Electronic Beam Steering

Figure 2:
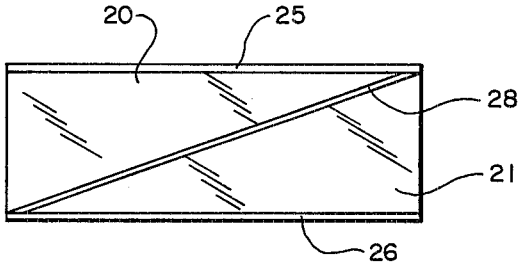
FIG. 2 is a diagrammatic plan view of a pair of beam steering prisms made in accordance with the present invention and suitable for use in an electronic beam steering device.

In accordance with the present invention, there has been provided an improved passive electronic beam steering system employing a pair of prisms 20, 21 (FIG. 2) which are configured in back-to-back relation so as to define a beam steering structure of generally constant uniform thickness and adapted to be mounted in the aperture of a conventional antenna. In carrying out the invention, the prisms 20, 21 are formed of a ferroelectric dielectric material having the characteristic of a very high dielectric constant which is a function of the electric field imposed on the material. Typical ferroelectric materials that are suitable for use with the present invention are: $BaTiO_3$, $LiNbO_3$, $LiTaO_3$, $Bi_{12}SiO_{20}$ (BSO) and $Bi_{12}GeO_{20}$ (BGO). As is well known to those skilled in the art, the establishment of a controllably variable DC field in such ferroelectric dielectric materials causes the incremental permittivity thereof to be changed, thus changing the prism refraction angle and deflecting the direction of radiation of energy from an antenna (not shown).

In order to permit establishment of a controllable DC electric field in the prisms 20, 21 so as to stress the dielectric material, each prism is fabricated in such a manner as to provide relatively thin laminations of dielectric material separated by a plurality of thin, metallized, prism shaped, interdigitated conductive layers 22, 24 imbedded in the ferroelectric dielectric material, with all of the conductive layers 22 being coupled to the terminal A of a suitable source of DC voltage "v" (not shown) and with the conductive layers 24 alternating with layers 22 being coupled to the terminal B of the voltage source. The arrangement is such that the composite dielectric prisms 20, 21 are each defined by dieletric material within which are positioned closely spaced alternating metallized electrodes 22, 24 which are prism shaped and parallel in much the fashion of a fully open venetian blind. Such an arrangement permits attainment of strong electric fields with relatively low voltages and, moreover, the fields are extremely uniform across the dielectric prism, thereby tending to transmit highly focused energy beams. Moreover, the fact that the electric field reverses in alternate spaces does not effect the ferroelectric properties of the material or the operation of the beam steering prism structure.

Because ferroelectric dielectric prisms of the foregoing character are characterized by high dielectric constants, it is desirable to employ quarter-wave anti-reflection layers 25, 26 at the faces of the prisms 20, 21 respectively. Similarly, it is desirable that a quarter-wave anti-reflection layer 28 be interposed between the prisms. Such quarter-wave anti-reflection layers 25, 26 and 28 preferably have a permittivity equal to the mean value of the dielectric constants of the prisms.

The interdigitated bias electrodes 22, 24 may be either perpendicular or parallel to the polarization plane of radiated energy; but, if parallel, the spacing between adjacent electrodes cannot be less than one-half the wavelength in the dielectric of the incident radiation.

Figure 4:
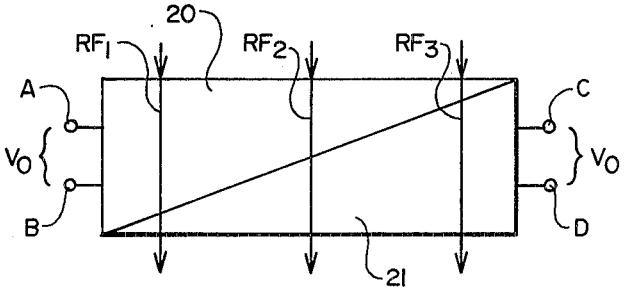
FIG. 4 is a diagrammatic view here illustrating a pair of back-to-back crystals made in accordance with the present invention and wherein the voltages applied to the terminals of the crystals are equal and selected so as to permit transmission of an energy beam without deflection thereof.

Referring now to FIG. 4, and assuming that the voltage $v_0$ applied to prism 20 across its terminals A, B is equal to the voltage $v_0$ applied to prism 21 across its terminals C, D, then the dielectric constants established in the prisms 20, 21 will be the same and there will be no deflection of incident radiation such as that represented by the rays $RF_1$ through $RF_3$. Thus, because the prisms 20, 21 are mounted in back-to-back relation and because both prisms have the same dielectric constant, incident radiation defining the energy beam passes directly through the composite beam steering structure without deflection and without distortion or defocusing.

Considering next FIG. 5, it will be observed that the voltage $v_1$ applied across the terminals A, B of prism 20 has been increased relative to the voltage $v_2$ applied across the terminals C, D of prism 21. As a consequence, incident radiation $RF_1$ through $RF_3$ impinging upon prism 20 deflected to the right as viewed in FIG. 5 and exits from the face of prism 21 at a deflected angle which is a function of the voltages applied to the two prisms, the materials from which they are made, and other design parameters. If, on the other hand, the voltage $v_2$ applied across the terminals C, D of prism 21 is increased relative to the voltage $v_1$ applied across the terminals A, B of prism 20, then incident radiations $RF_1$ through $RF_3$ impinging upon the face of prism 20 will be deflected to the left at the interface between the prisms 20, 21, thus deflecting the radiation beam exiting from the composite structure to the left as shown in FIG. 6.

In sum, those skilled in the art will appreciate that an RF signal normally incident upon prism 20 will tend to be deflected to the right as viewed in FIGS. 4 through 6, entering prism 21 at the interface therebetween which in turn deflects the RF signal to the left. Assuming the entering and exiting faces of the composite prism assembly are parallel, the beam will have a net deflection of:

$$\alpha = \text{Arctan}\left(\frac{\text{thickness}}{\text{length}}\right)\left(\sqrt{\epsilon_{r20}} - \sqrt{\epsilon_{r21}}\right)$$

Thus, if the dielectric constants $\epsilon_r$ of both prisms are equal, the beam emanating from the composite structure will have no net deflection (FIG. 4). If, on the other hand, the dielectric constant $\epsilon_r$ of prism 20 were equal to 120 and that for prism 21 were equal to 80, the net beam deflection would be 14° to the right (Cf. FIG. 5). If the dielectric constant $\epsilon_r$ of prism 20 were equal to 80 and the dielectric constant $\epsilon_r$ for prism 21 were equal to 120, the deflection would be 14° to the left (Cf. FIG. 6). Those skilled in the art will appreciate that the foregoing numerical values are herein set forth for illustrative purposes only; and, the exact values will be dependent upon the particular ferroelectric materials employed and other design parameters. Thus, it is seen that by employing back-to-back prisms 20, 21, the antenna boresite radiation direction remains unchanged and there is left/right symmetry to the beam steering parameters.

Considering next FIGS. 7 through 9 conjointly, there has been illustrated a slightly modified form of the invention which here permits of beam steering along either or both of the "X" and "Y" coordinates (Cf. FIG. 1). Thus, as here illustrated, it will be noted that a composite beam steering device, generally indicated at 30, has been provided consisting of a first pair of back-to-back prisms 20, 21 formed of ferroelectric dielectric material and a second pair of back-to-back prisms 20', 21' with the prisms being so arranged that prisms 20, 21 are characterized by their ability to deflect incident radiation along an "X" coordinate, while prisms 20', 21' are characterized by their ability to deflect incident radiation along a "Y" coordinate. Thus, referring to FIGS. 7 and 8 conjointly, an assuming that the voltage applied across the terminals A, B of prism 20 to be greater than that applied across the terminals C, D of prism 21, then the incident radiation RF will be deflected slightly to the right at the interface between the prisms 20, 21 and somewhat further to the right as the beam exits from prism 21—i.e., here will be a net deflection to the right along the "X" coordinate as viewed in FIG. 8. The beam exiting from prism 21 will be transmitted through the back-to-back prisms 20', 21' without the latter influencing the change in direction along the "X" coordinate; and, this is true irrespective of the electric fields created in the prisms 20', 21'. Similarly, referring to FIGS. 7 and 9 conjointly, it will be appreciated that incident radiation RF impinging upon prism 20 will pass directly through back-to-back prisms 20, 21 without being influenced thereby insofar as deflection along the "Y" coordinate is concerned; and, will thereafter impinge upon prism 20'. Assuming that the voltage applied across the terminals A', B' of prism 20' is less than the voltage applied across the terminals C', D' of prism 21', then the incident radiation RF will be deflected downwardly at the interface between the prisms 20', 21' and will exit from prism 21' in a downward direction at a somewhat greater angle—i.e., the prisms 20', 21' will function to steer the incident radiation beam RF along the "Y" coordinate.

In short, the arrangement disclosed in FIGS. 7 through 9 is such that if the voltages applied across terminals A, B of prism 20 are different than the voltages applied across the terminals C, D of prism 21, there will be deflection of the radiation beam along the "X" coordinate in either a left or right direction dependent upon the relative values of the voltages applied and the magnitude of the voltage differences. If the voltages applied to the terminals A, B of prism 20 are the same as those applied across the terminals C, D of prism 21, there will be no "X" coordinate deflection of the beam RF. Similarly, the beam exiting prism 21 and impinging upon prism 20' will be deflected along the "Y" coordinate only if the voltages applied cross the terminals A', B' of prism 20' are different in magnitude from those applied across the terminals C', D' of prism 21'. Thus, by selectively controlling the voltages of the four back-to-back ferroelectric dieletric prisms 20, 21 and 20', 21', the dielectric constants thereof can be selectively varied permitting change of the incremental permittivity and the prism refraction angle for each prism independently of the other; thereby enabling the beam of incident radiation RF to be deflected only along the "X" coordinate (where the dielectric constants of prisms 20, 21 are different and the dielectric constants of prisms 20', 21' are equal), only along the "Y" coordinate (where the dielectric constants of prisms 20, 21 are the same and the dielectric constants of the prisms 20', 21' are different), or simultaneously along both coordinates (where the dielectric constants for the prisms 20, 21 are different and the dielectric constants for the prisms 20', 21' are different).

Finally, those skilled in the art will appreciate that the beam steering characteristics of the present invention do not require that the composite prism structure be rectilinear in configuration. Thus, the prisms can be round or of any other desired shape to meet specific design requirements. Indeed, and as best shown by reference to FIG. 10, it will be noted that the prisms 20A and 21A can be curvilinear defining a curved composite structure in which the exposed face of prism 20A is parallel to the exposed face of prism 21A. Nevertheless, because the two prisms define a composite beam steering structure of uniform thickness, variable control of the dielectric constants of prisms 20A, 21A in the manner previously described will result in controlled deflection of incident radiation. Thus, the arrangement is such that the composite curvilinear structure of the beam steering prisms can be made conformal to, for example, the aerodynamic surface of the radome associated with the host vehicle. Indeed, with proper design, the prism structure described may comprise the aerodynamic surface of the radome.

Figure 3:
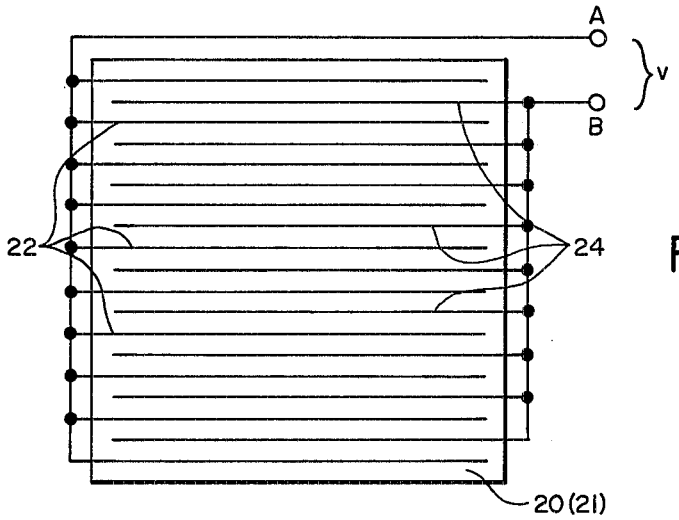
FIG. 3 is a diagrammatic elevational view of one of the two beam steering prisms shown in FIG. 2 illustrating particularly the interleaved construction of the nonlinear ferroelectric crystal and a series of alternating thin metal conductive layers imbedded in the ferroelectric crystal material and connected to the positive and negative terminals of a suitable DC voltage source (not shown) for controlling the dielectric constant (index of refraction) of the crystal so as to cause controlled deflection of the transmitted energy beam.

There may be some instances where it is desirable to prevent all RF signals other than those within a specific relatively narrow preselected frequency band from reaching the antenna. The present invention readily permits of such an arrangement. Thus, if the metallized conductive layers 22, 24 (FIG. 3) are orthogonal, at frequencies below cutoff (considering spacing of the layers 22,24 and permittivity), the composite prism assembly becomes totally reflecting and no energy outside of the preselected frequency band can reach the antenna.

Those skilled in the art will appreciate that there has hereinabove been described a simple, lightweight and highly reliable precision beam steering device which is totally devoid of moving components. As a consequence, beam steering may be achieved along "X" and/or "Y" coordinates without movement of any physical component and without alteration of the center of mass of the host vehicle. There is no need for complex mechanical, electromechanical and/or hydraulic actuating mechanisms, and no relatively moving parts which require lubrication and/or which are subjected to wear. The system is virtually devoid of maintenance and/or service requirements, and may be exercised at will even when employed in vehicles having short life spans and which are normally stowed until placed in use—e.g., missiles.

We claim as our invention:

1. The method of steering an RF signal beam comprising:

(a) forming a composite prism structure comprising n pairs of back-to-back prisms of ferroelectric dielectric material where "n" equals 1 or 2 and wherein the entrance face of the composite prism structure is parallel to the exit face of the composite prism structure;

(b) directing the RF signal beam along an axis general normal to and passing through the entrance face of the n pair of back-to-back prisms; and, (c) selectively varying the dielectric constant of one prism in at least one of the n prism pairs relative to the dielectric constant of the other prism in the one of the n pairs so as to steer the RF signal beam transiting each of the n pairs of prisms through a selected angle to either side of the RF signal beam axis along at least one of an "X" and/or "Y" coordinate and wherein the RF signal beam is deflected from the axis only when the dielectric constant of one prism in each of the n pairs of prisms is different than that of the other prism in each of the n pairs of prisms.

2. The method of steering an RF signal beam as set forth in claim 1 wherein "n" equals 1 and the RF signal beam is steerable only along one of an "X" or "Y" coordinate.

3. The method of steering an RF signal beam as set forth in claim 1 wherein "n" equals 2 and the RF signal beam is steerable along an "X" coordinate by varying the dielectric constant of at least one of the prisms defining one of the two pairs of back-to-back prisms and along a "Y" coordinate by varying the dielectric constant of at least one of the prisms defining the other of the two pairs of back-to-back prisms.

4. The method of steering an RF signal beam as set forth in claims 1, 2 or 3 where each prism in each of the n pairs of prisms include a plurality of closely spaced parallel conductive layers lying in planes normal to the entrance and exit faces of the composite prism structure and wherein alternate ones of the conductive layers in each prism are coupled to one terminal of a DC voltage source and the intervening ones of the conductive layers of that prism are coupled to the other terminal of the DC voltage source and the dielectric constant of each prism is variable independent of the dielectric constant of all other prisms by varying the voltage applied across the terminals of that prism so as to vary the electric field and stress the ferroelectric dielectric material of the prism.

5. The method of steering an RF signal beam as set forth in claims 1, 2 or 3 wherein the ferroelectric dielectric material is selected from the group consisting of:

$BaTiO_3$;
$LiNbO_3$;
$LiTaO_3$;
$Bi_{12}SiO_{20}$; and,
$Bi_{12}GeO_{20}$.

6. The method of steering an RF signal beam as set forth in claims 1, 2 or 3 wherein the RF signal beam is in the millimeter wave region.

7. An electronic beam steering device for steering an RF signal beam comprising, in combination: a composite prism structure including n pairs of back-to-back prisms formed of ferroelectric dielectric material wherein "n" equals 1 or 2; each of said n pairs of back-to-back prisms defining parallel entrance and exit faces on opposed sides thereof and through which the RF signal beam passes; and, means for selectively varying the dielectric constant of one prism in each of said n prism pairs relative to the dielectric constant of the other prism in each of said n prism pairs so as to steer the RF signal beam transiting each of the n pairs of prisms through a selected angle to either side of an axis normal to said exit face along at least one of an "X" and/or "Y" coordinate and wherein the RF signal beam is deflected from the axis only when the dielectric constant of one prism in each of said n pairs of prisms is different than that of the other prism in each of said n pairs of prisms.

8. An electronic beam steering device as set forth in claim 7 wherein "n" equals 1 and the RF signal beam is steerable only along one of an "X" or "Y" coordinate.

9. An electronic beam steering device as set forth in claim 7 wherein "n" equals 2 and the RF signal beam is steerable along an "X" coordinate by varying the dielectric constant of at least one of the prisms defining one of said two pairs of back-to-back prisms and along a "Y" coordinate by varying the dielectric constant of at least one of the prisms defining the other of said two pairs of back-to-back prisms.

10. An electronic beem steering device as set forth in claim 7 wherein said parallel entrance and exit prism faces are planar.

11. An electronic beem steering device as set forth in claim 7 wherein said parallel entrance and exit prism faces are curvilinear.

12. An electronic beam steering device as set forth in claim 7 and adapted to be mounted in a radome of a host vehicle and wherein said entrance and exit prism faces are conformal in shape to the aerodynamic outer surface of said radome.

13. An electronic beam steering device as set forth in claim 12 wherein said exit prism face comprises said radome aerodynamic surface.

14. An electronic beam steering device as set forth in claims 7, 8, 9, 10, 11, 12 or 13 further including a DC voltage source wherein each prism in each of said n pairs of prisms include a plurality of closely spaced parallel conductive layers embedded in said ferroelectric dielectric material and lying in planes normal to said entrance and exit faces of the composite prism structure and wherein alternate ones of said conductive layers in each of said prisms are coupled to one terminal of said DC voltage source and the intervening ones of said conductive layers of that prism are coupled to the other terminal of said DC voltage source and the dielectric constant of each prism is variable independent of the dielectric constant of all other prisms by varying the voltage applied across the terminals of that prism so as to vary the electric field and stress the ferroelectric dielectric material of said prism.

15. An electronic beam steering device as set forth in claims 7, 8, 9, 10, 11, 12 or 13 wherein said ferroelectric dielectric material is selected from the group consisting of:

$BaTiO_3$;
$LiNbO_3$;
$LiTaO_3$;
$Bi_{12}SiO_{20}$; and,
$Bi_{12}GeO_{20}$.

16. An electronic beam steering device as set forth in claims 7, 8, 9. 10, 11, 12 or 13 wherein said RF signal beam is in the millimeter wave region.

* * * * *